United States Patent [19]

Tan et al.

[11] 4,293,230

[45] Oct. 6, 1981

[54] APPARATUS FOR PROVIDING FUEL FOR AN OIL BURNER

[76] Inventors: Lu J. Tan; David Tan; Jeff Tan, all of 37-53 102st St., Corona, N.Y. 11368

[21] Appl. No.: 895,071

[22] Filed: Apr. 12, 1978

[51] Int. Cl.[3] ..... B01F 3/08; B01F 13/02

[52] U.S. Cl. ..... 366/101; 123/25 B; 123/25 E; 261/18 B; 366/148; 366/174; 366/338; 431/4

[58] Field of Search ..... 366/101, 107, 148, 150, 366/162, 174, 177, 336, 338; 431/4; 261/18 A, 18 B, 121 A; 123/25 R, 25 A, 25 B, 25 E, 141; 60/39.05

[56] References Cited

U.S. PATENT DOCUMENTS

| | | | |
|---|---|---|---|
| 1,177,538 | 3/1916 | Roberts | 261/18 A |
| 1,519,830 | 12/1924 | Goeriz | 431/4 |
| 2,788,337 | 4/1957 | Preiswerk et al. | 366/101 X |
| 3,658,302 | 4/1972 | Duthion et al. | 366/119 |
| 3,749,318 | 7/1973 | Cottell | 431/4 X |
| 3,818,876 | 6/1974 | Voogd | 123/25 R |
| 3,921,389 | 11/1975 | Kawaguchi | 60/39.05 |

FOREIGN PATENT DOCUMENTS

| | | | |
|---|---|---|---|
| 1040703 | 5/1953 | France | 261/18 B |
| 852125 | 10/1960 | United Kingdom | 366/101 |

OTHER PUBLICATIONS

Ivanov and Nefedov, "Experimental Investigation of the Combustion Process of Natural and Emulsified Liquid Fuels", 1962.

Dryer, F. L., "Fundamental Concepts on the Use of Emulsions as Fuels", Apr. 1975.

Dooher, J., et al., "Emulsions as Fuels", Nov. 1976, pp. 36-41.

Dryer, F. L., "Water Addition to Practical Combustion Systems—Concepts and Applications", Apr. 15-20, 1976.

*Primary Examiner*—Philip R. Coe

*Attorney, Agent, or Firm*—Brumbaugh, Graves, Donohue & Raymond

[57] ABSTRACT

A fuel is prepared for efficient combustion in an oil burner by mixing fuel oil with from 30 to 60% by volume of water. The apparatus for mixing the oil and water include turbulence created by fluid flow and turbulence created by mechanical agitation. Compressed air used to create turbulence and mixing provides better combustion and less pollution when burning the resulting mixture.

14 Claims, 10 Drawing Figures

FIG. 4
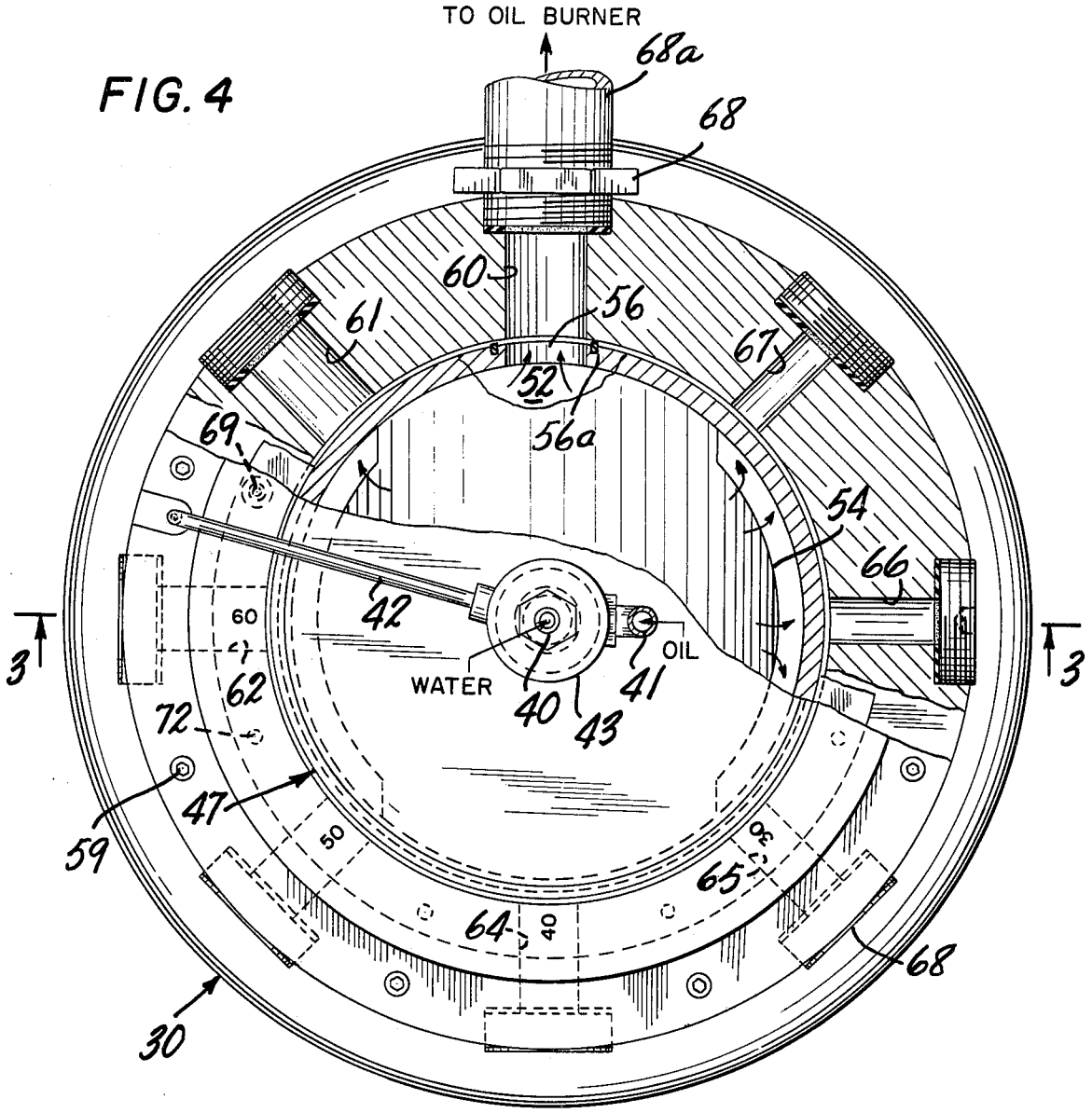
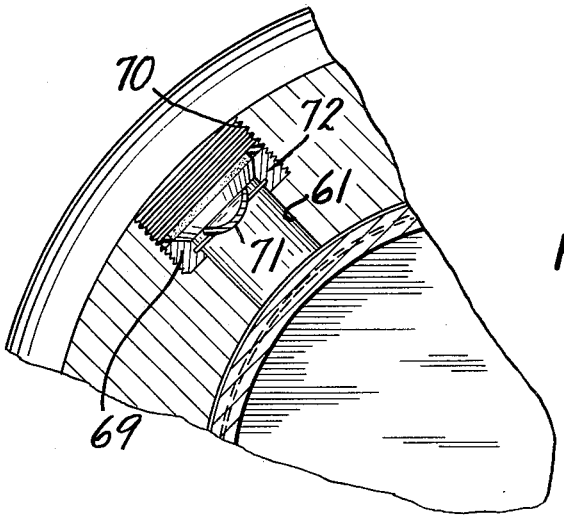
FIG. 4a

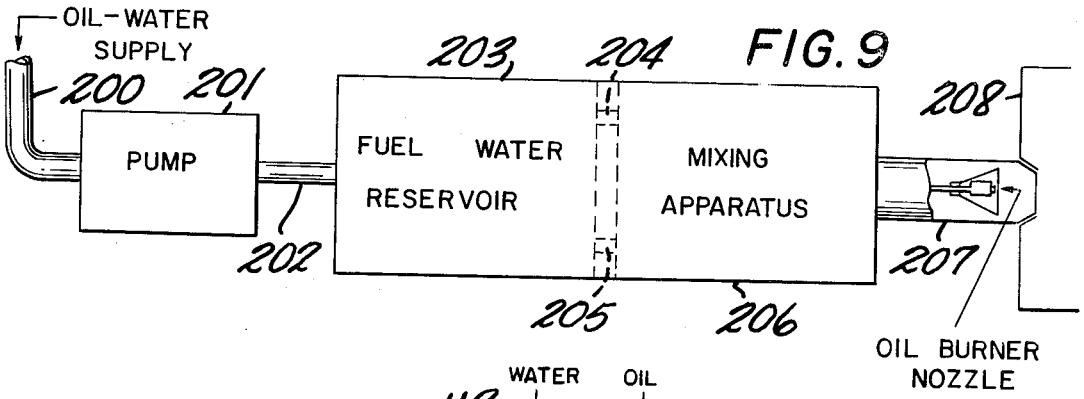
FIG. 9
FIG. 6
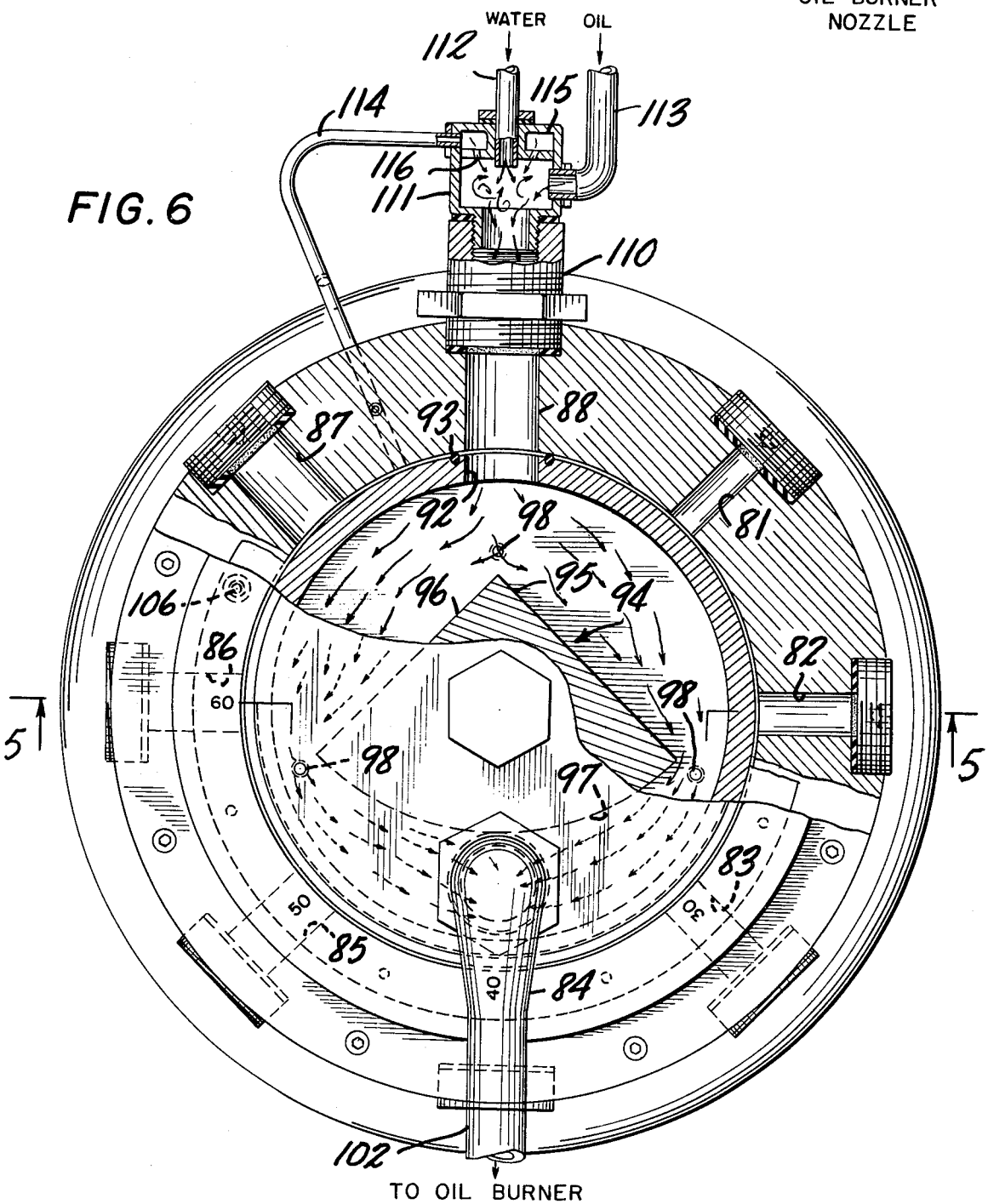

APPARATUS FOR PROVIDING FUEL FOR AN OIL BURNER

BACKGROUND OF THE INVENTION

It is of the utmost importance in the interests of cost, conservation and pollution control to obtain optimum efficiency in burning fuel oil and other petroleum products. To this end, there have been proposals for mixing various amounts of water with fuel oil in order to promote combustion efficiency. These proposals have included the use of chemicals to provide oil emulsions, supersonic sound waves, catalysts, electric currents and mechanical mixing, all to promote and retain the mixture of oil and water.

A serious problem with some such mixtures has been separation of the oil and water during storage or transportation of the oil and water mixture, and also thickening of the mixture in cold temperatures. Moreover, methods and apparatus for mixing large quantities of oil and water have proven cumbersome, expensive, or both, and have not been efficient or economically feasible.

SUMMARY OF THE INVENTION

It is therfore a principal object of the present invention to provide a new fuel for a burner comprising a mixture of oil and water which provides more efficient combustion than produced in the past. In accordance with the invention, 30 to 60% by volume of water is injected into fuel oil. Turbulence in the oil and water mixture is then created by fluid motion, compressed air, or mechanical agitation, or a combination thereof. The oil and water mixture is then conveyed to an oil burner for immediate and efficient combustion.

In one embodiment of the present invention, the water is injected into flowing fuel oil, the mixture then being introduced under pressure into a first mixing chamber and directed against a baffle. The resulting turbulence further mixes the water and oil which can then be directed into a second mixing chamber against a second baffle to provide further turbulence and mixing. Compressed air injected into the second chamber, which can also be injected into the first chamber, results in further mixing of the oil and water to produce an efficient fuel for immediate use which is delivered to an oil burner for efficient combustion.

In an embodiment of the invention, heated water at a temperature in excess of 150° F. is mixed with the fuel oil. The oil can also be heated to a temperature between 125° and 175° F. The oil and water mixed according to the present invention provides more efficient combustion, conservation of fuel and less atmospheric pollution.

BRIEF DESCRIPTION OF THE DRAWINGS

For a better understanding of the invention, reference should be made to the following description taken in conjunction with the accompanying drawings, in which:

FIG. 4 is a plan view, partially broken away, of the embodiment shown in FIG. 3;

FIG. 4*a* illustrates a modification of the outlets of the embodiment shown in FIGS. 3 and 4;

FIG. 6 is a plan view, partially broken away, of the embodiment shown in FIG. 5;

FIG. 9 is another embodiment of the invention shown in block form.

Figure 1:
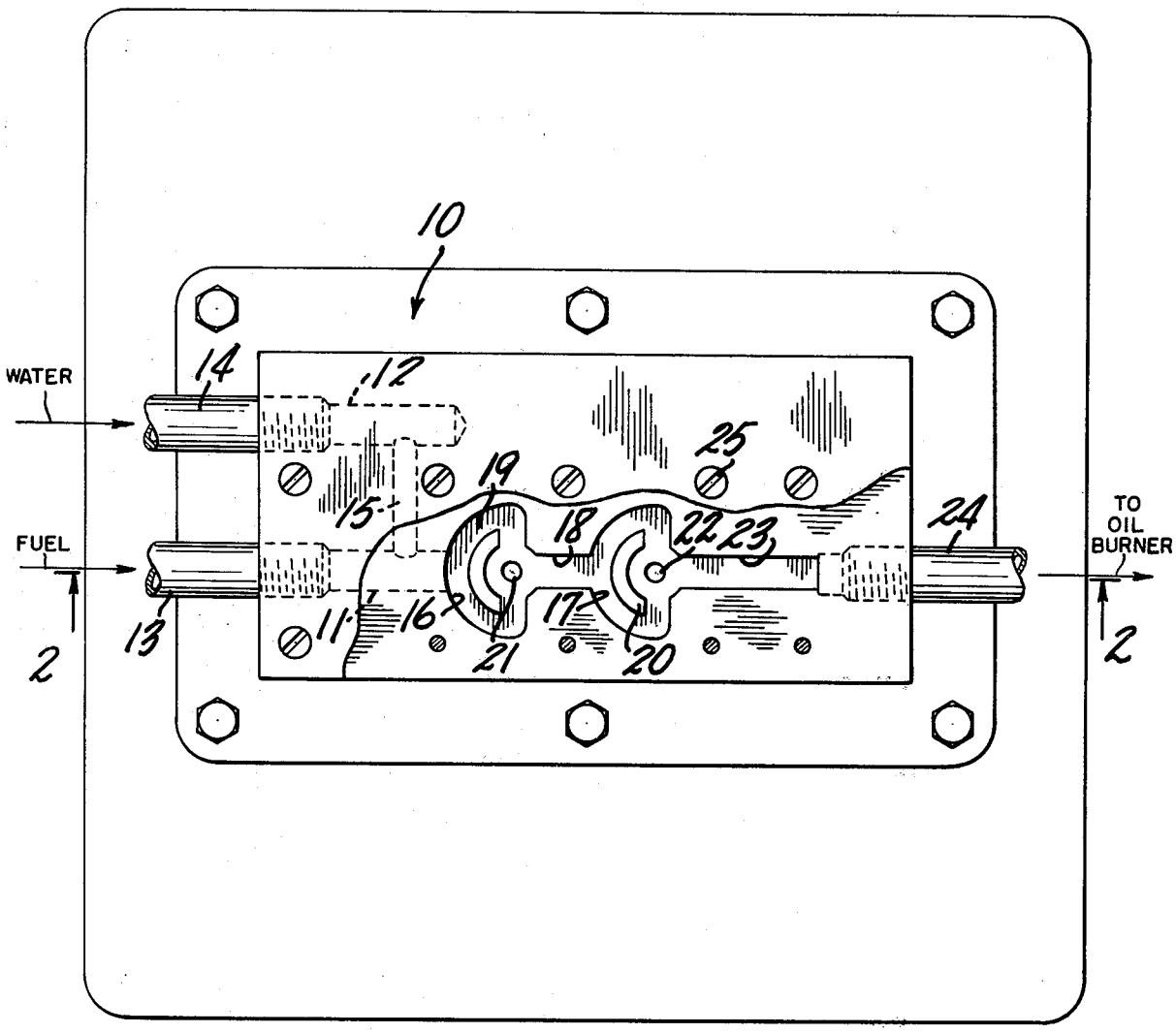
FIG. 1 is a plan view, partially broken away, of one embodiment of the invention for preparing an efficient fuel for combustion in an oil burner.
Figure 2:
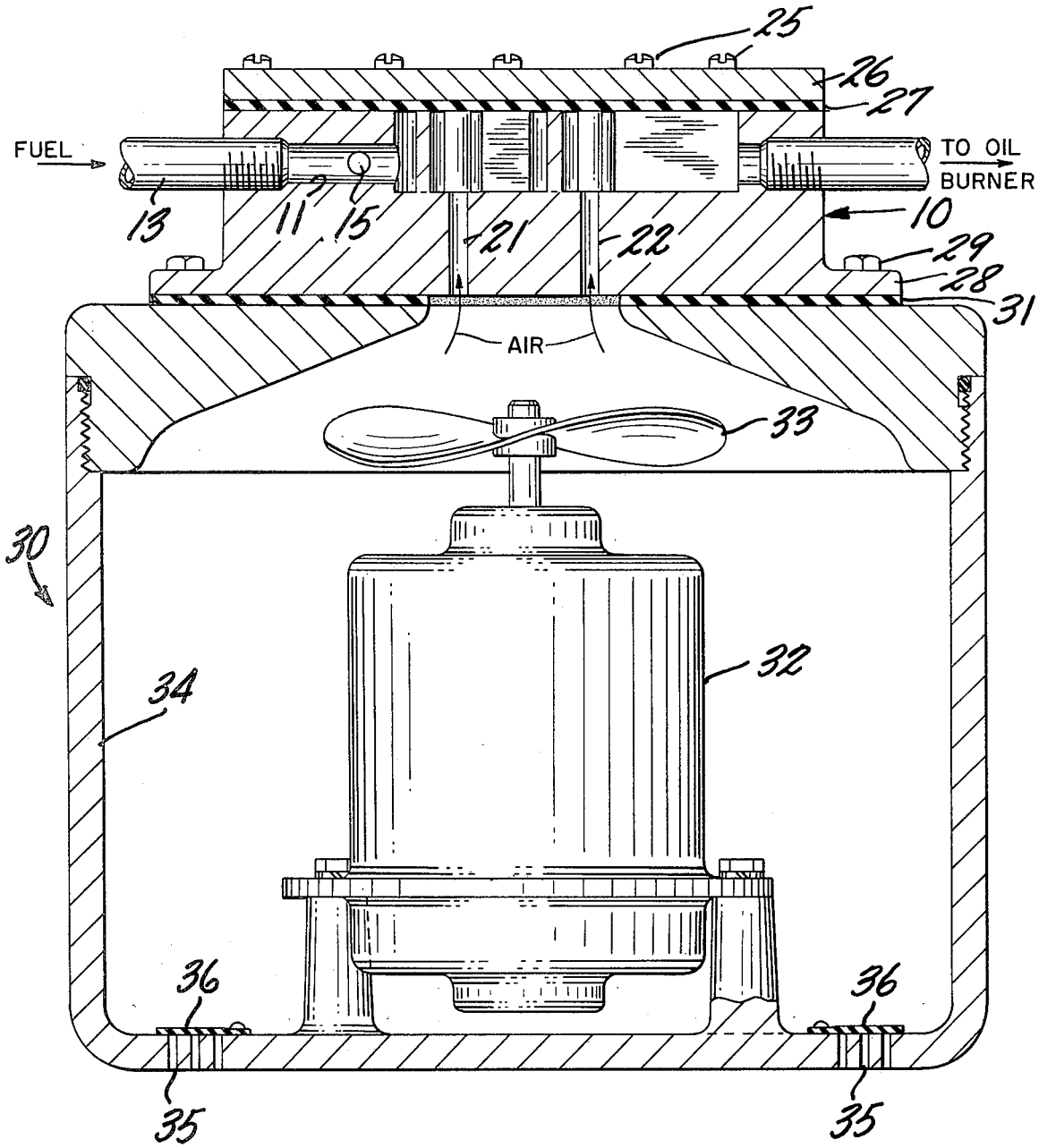
FIG. 2 is a cross-section taken along the view line 2—2 of FIG. 1 looking in the direction of the arrows.

Referring to the embodiment of the invention shown in FIGS. 1 and 2 in greater detail, a metal block 10 is drilled and tapped to provide inlets 11 and 12 into which fuel oil and water conduits or pipes 13 and 14, respectively, are threaded. A passage 15 in the block 10 extends between the inlets 11 and 12 to flow or inject water under pressure to the flow of fuel oil, as indicated in FIG. 1.

Two mixing chambers 16 and 17, coupled by a passage 18 in the block 10, include baffles 19 and 20, respectively, and air inlets 21 and 22, respectively. The baffle 19 is spaced from the inlet end of the chamber 16 to provide a flow volume of oil and water mixture equal to that delivered by the inlet conduit 11 divided evenly as it flows around the baffle in the chamber. The same relationship holds true with the baffle 20 in the chamber 17.

An outlet or delivery conduit 23 leads from the chamber 17 and is tapped to receive threaded outlet conduit or pipe 24 which is connected to a conventional oil burner in a furnace.

Screws 25 secure a closure plate 26 to the block 10, a gasket 27 effectively sealing the passages and chambers in the block. A flange 28 on the block 10 is secured by bolts 29 to a compressor 30 with a gasket 31 sealing the connection. The compressor 30, shown diagrammatically for simplicity, includes a motor 32 driving a fan 33 and mounted in a housing 34. Openings 35 closed by flaps 36 admit air to the housing. Air under pressure, for example 5–20 psi, is provided by the compressor 30 to the air ducts 21 and 22. Note that any suitable air compressor can be used, for example, compressed air provided by a conventional oil burner.

In operation, water and oil are flowed together and premixed in the inlet 11. The mixture jets against the baffle 19, such fluid motion creating turbulence and mixing, and swirls through the chamber 16 where the compressed air is directed into the mixture to cause further turbulence. The resulting fuel oil and water mixture then passes through the duct 18 and undergoes the same type of mixing operations in the chamber 17 to provide efficient fuel for immediate delivery to an oil burner by the outlet 23 and pipe 24.

In an exemplary embodiment of the invention, inlets 11 and 12 were $\frac{1}{4}$ inch in diameter and passage 15 was $\frac{1}{8}$ inch in diameter to mix substantially 50% by volume of water with No. 2 fuel oil. The oil and water was supplied to the chamber 16 at 3 gallons per hour with the fuel oil and water being furnished to the pipes 13 and 14 at 100 psi. Air at 30 psi entered the chambers through ⅛ inch ducts 21 and 22, and the resulting fuel was delivered to a conventional oil burner and provided very efficient combustion. Note that the chambers 16 and 17 and baffles 19 and 20 shown in FIG. 1 are drawn to scale with the passages having the above stated dimensions.

If desired, the air duct 21 can be omitted. Further, the second mixing chamber 17 may be omitted, the air duct 21 remaining, with some loss in efficiency. Also, while the passage 15 is sized to provide for mixing an equal quantity of fuel oil and water with the pressures used in the example described, i.e., 50% by volume of water, the oil and water pressures and the duct and conduit sizes may be varied to provide from 30 to 60% water by volume of water in the oil and water mixture, and such efficient fuels when used immediately provide efficient combustion.

It has also been found that an even more efficient fuel can be produced by heating the incoming water to a temperature in excess of 150° F. In one exemplary process, the water was supplied at the boiling point to produce an efficient fuel.

Heating of the fuel oil can also produce a more efficient fuel, the oil being heated to a temperature in the range of 140° to 170° F.

Figure 3:
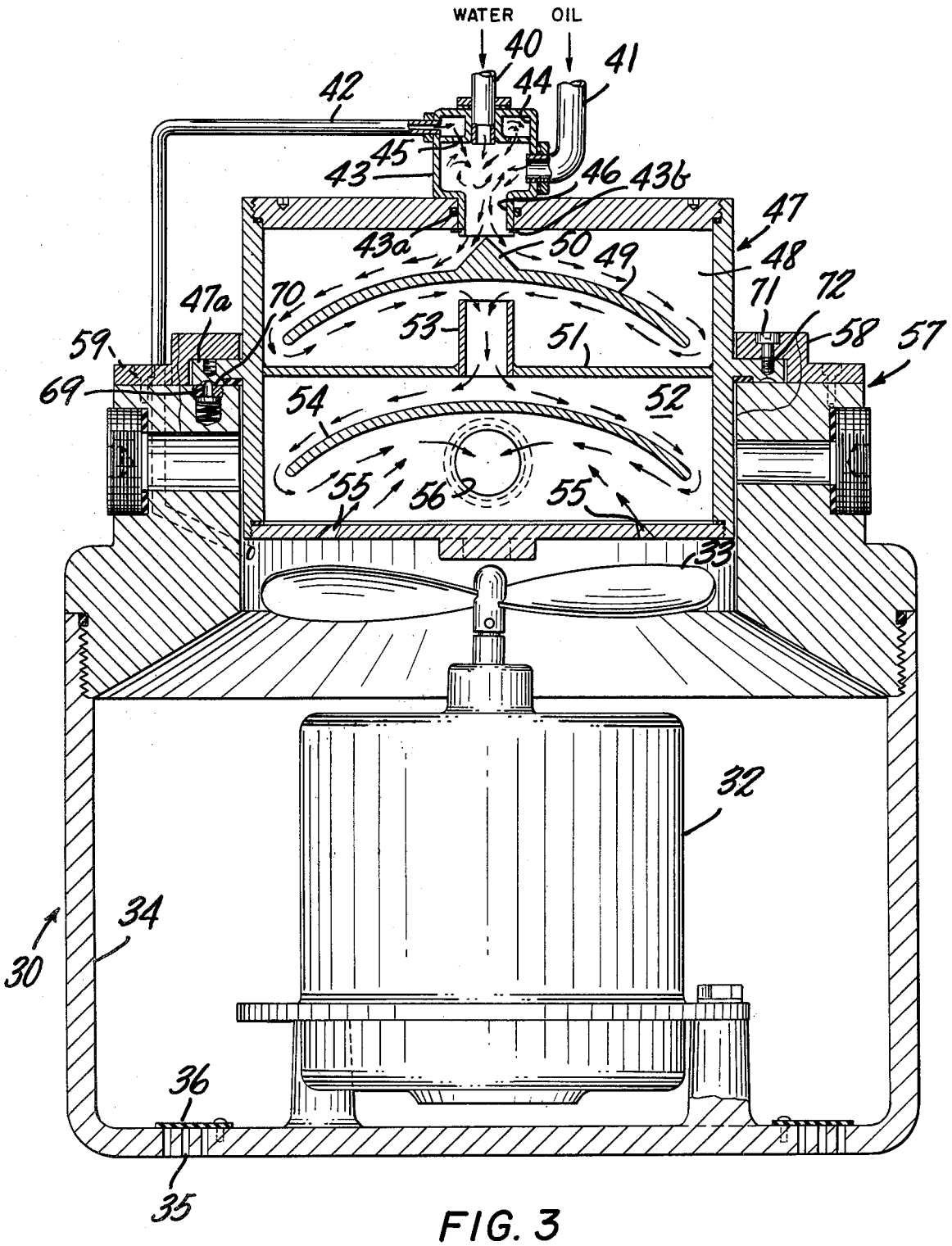
FIG. 3 is a view in section taken along the view line 3—3 of FIG. 4 of another embodiment of the invention for preparing an efficient fuel for combustion in an oil burner.

Referring next to the embodiment of the invention shown in FIGS. 3 and 4, oil, water and air pipes 41, 40 and 42, respectively, are coupled to a premixing chamber 43. At the upper part of the chamber a circumferential air chamber 44 with openings 45 distributes compressed air to the chamber 43 to atomize the incoming water.

The oil and water mixture is directed through an opening 46 in a housing 47 to an upper mixing chamber 48. A baffle 49 formed with a conical portion 50 is provided in the chamber 48. A divider 51 in the housing 47 forms another mixing chamber 52 communicating with the chamber 47 through a duct 53. A baffle 54 formed in the chamber 52 causes further mixing. A number of openings 55 circumferentially spaced in the floor of the housing 47 distribute compressed air to the chamber. An opening 56 in the side wall of the housing 47 forms an outlet for the oil and water mixture fuel.

The compressor 30, diagrammatically shown for simplicity the same as the compressor 30 of FIGS. 1 and 2, provides air at a pressure, for example from 5–20 psi, to the duct 42 and the openings 55.

To provide an inventive device suited for use with a wide variety of oil burners, i.e., burners of different sizes and heating capacities, the housing 47 is rotatably mounted in a cylindrical base 57 formed with eight differently sized outlets selectively registrable with the outlet 56 in the housing 47. To this end, a circumferential flange **47*a* on the housing 47 is captured by a ring 58 secured to the base 57 by screws 59. Eight differently sized outlets 60–67 extend radially through the base 57 to standard size threaded couplings 68 adapted to be connected to an oil burner coupling pipe 68*a*. An O-ring 56*a* encircles the outlet 56 to seal the outlet 56 to the duct 60–67** selected.

To register the outlets simply and accurately, a spring-loaded detent 69 enters one of eight indentations 70. To hold the housing 47 against rotation in the base 57 after a particular outlet 60–67 has been selected, a screw 71 fits one of the tapped holes 72 on the flange **47*a***.

When the housing 47 is rotated, the chamber 43 remains stationary and is sealed by an O-ring **43*a* in the opening 46, and secured by a split ring 43*b***.

In operation of the embodiment shown in FIGS. 3 and 4, after selecting the proper size outlet 60–67 and securing the housing 47 and base 57 by the screw 71, water, oil and air are flowed into the chamber 43 resulting in turbulence created by fluid motion. The resulting mixture jets against the cone 50 and baffle 49, causing great turbulence and further mixing. The oil and water mixture then exits to the chamber 52, impinges on the baffle 54 and, after further turbulence and mixing, is delivered as an efficient fuel for immediate combustion to the outlet 60 and the oil burner coupling **68*a***.

The percentage of oil and water mixed is the same as described in connection with FIGS. 1 and 2. The resulting mixture when burned provides for vastly improved combustion efficiency. Moreover, heating of the water and/or the oil can also improve the efficiency of the fuel provided by the apparatus.

In a modification of the embodiment of the invention shown in FIGS. 3 and 4, as shown in FIG. **4*a*, a threaded plug 69 fits a tapped opening 70 at the end of the outlets 60–67, the outlet 61 being shown in FIG. 4*a*. Provided within the plug 69 is a baffle 71 supported by a plurality of radial rod-like supports 72. When the oil and water mixture passes through the outlet 61, it strikes the baffle 71, thereby creating turbulence and further mixing just prior to delivery of the efficient fuel to the pipe 68*a*** leading to the oil burner. This further enhances combustion of the fuel.

Figure 5:
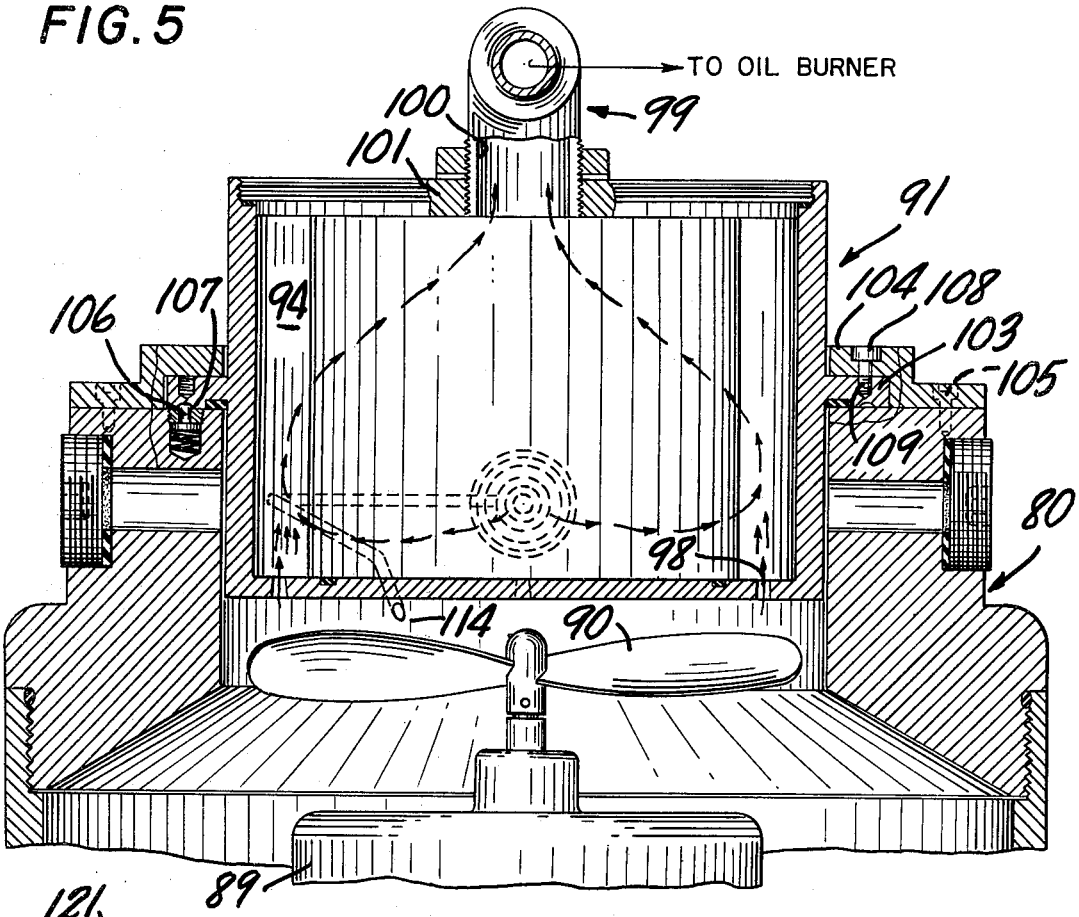
FIG. 5 is a view in section of still a further embodiment of the invention taken along the view line 5—5 of FIG. 6 looking in the direction of the arrows.

Turning next to the embodiment shown in FIGS. 5 & 6, a generally cylindrical housing 80 is formed with eight differently sized inlets 81–88. A compressor shown diagrammatically for simplicity, is formed by a motor 89 driving a fan 90 in the lower portion of the housing 80.

Fitted within the housing 80 is a rotatable chamber 91, cylindrical in form, having a radially-directed inlet port 92 around which a sealing O-ring 93 is provided. A generally triangular baffle 94 is positioned in the chamber 91, the baffle having flat sides 95 and 96 joined by a curved side 97. Formed in the floor of the chamber 91 adjacent the edges of the baffle 94 are air holes 98. An outlet 99 in the top of the chamber 91 includes a connector 100 threaded into a cover 101 which, in turn, is threaded into the top of the chamber 91. The connector 100 facilitates connection to a pipe 102 leading to an oil burner.

The chamber or housing 91, rotably mounted in the housing 80, includes a circumferential flange 103 captured by a ring 104 secured to the housing by screws 105. To register a selected one of the inlets 81–88 with the inlet port 92, a spring-loaded detent 106 enters one of eight indentations 107 on the underside of the flange 103. To hold the housing chamber 91 against rotation in the pipe 80 after a particular inlet 81–88 has been selected, a screw 108 fits one of the tapped holes 109 in the ring 103.

To supply fuel oil and water to a selected one of the inlets 81–88, a suitably threaded connector 110 is secured to the corresponding threaded portion of the inlet to be used. Coupled to the connector 110 is a premixing chamber 111 into which oil, water and air are admitted through conduits 113, 112 and 114, respectively. Note that the air line 114 communicates with the compressor formed by the fan 90 and the air is distributed by a circumferential air chamber 115 and injected into the mixing chamber through openings 116 to atomize the water entering through inlet 112.

In operation of the embodiment shown in FIGS. 5 and 6, the chamber 91 is rotated to place the port 92 in registration with one of the inlet passages 81–88, as desired. The passage selected will depend on the capacity of the oil burner being supplied by the fuel oil and water mixture fuel provided by the apparatus. The oil, water and compressed air then converge in the premixing chamber 111, where atomization, turbulence and mixing occur, and the mixture jets through the port 92 and against the straight edge of the triangular baffle 94 formed by the intersection of the flat sides 95 and 96. This divides the flow evenly, due to the configuration of the chamber and baffle, and creates great turbulence. Compressed air injected through the openings 98 causes further turbulence and mixing, and the resulting fuel is delivered through the outlet 99, coupling 100 and pipe 102 to the oil burner for efficient combustion.

Figure 7:
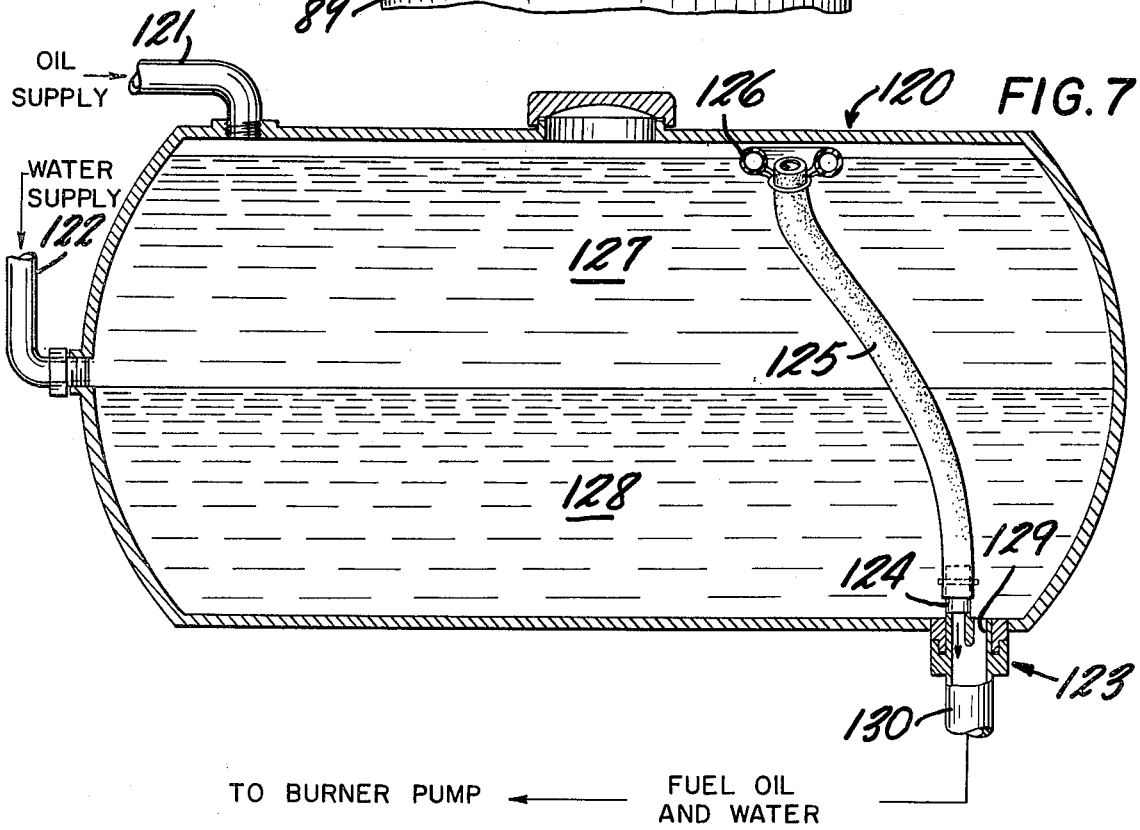
FIG. 7 is a device for use in storing and supplying oil and water in accordance with the invention.

In order to store and supply oil and water conveniently to the fuel mixing apparatus, a storage and supply device as shown in FIG. 7 can be used. A tank 120 has an oil supply line 121 and a water supply line 122. An outlet coupling 123 includes a tube 124 with a flexible hose 125 attached thereto. A float 126 is attached to the end of the hose to maintain its inlet just below the level of oil 127 in the tank in position to receive oil. Water 128 feeds through a duct 129 in the coupling 123. Pipe 130 is coupled to the inlet 123 and transmits oil and water to an oil burner pump or other suitable inlet to the fuel producing apparatus of the invention.

Figure 8:
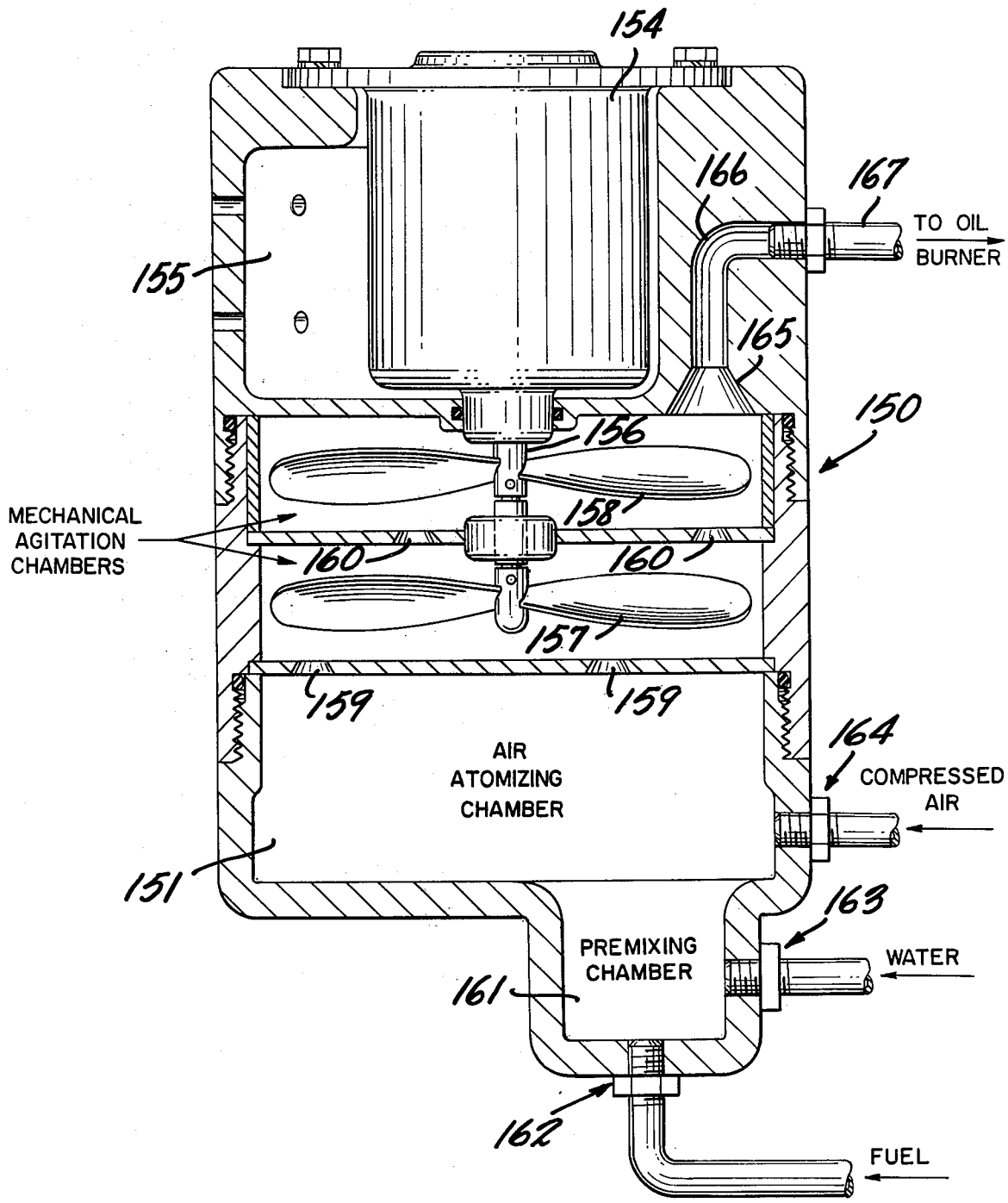
FIG. 8 is a cross-sectional view of still another embodiment of the invention in which mechanical agitation is used for preparing an efficient fuel for an oil burner.

In still a further embodiment of the present invention shown in FIG. 8, a housing 150 is formed with a lower chamber 151 and two middle chambers 152 and 153. A motor 154, mounted in an upper chamber 155, drives a shaft 156 carrying impellers 157 and 158 respectively located in the chambers 152 and 153. A plurality of openings 159 and 160 permit the flow of fluid from the chamber 151 through the chamber 152 to the chamber 153.

A premixing chamber 161, communicating with the chamber 151, includes an inlet 162 into which fuel oil flows, and an inlet 163 through which water flows. An inlet 164 in the chamber 151 is coupled to a source of compressed air.

Formed in the upper wall of the chamber 153 is an inlet port 165 from which leads an outlet passageway 166 suitably coupled to an outlet pipe 167 leading to an oil burner.

In operation, fuel oil and water under pressure are supplied to the premixing chamber 161 and thence to the chamber 151 adjacent to the compressed air inlet 164. The air turbulence causes mixing of the oil and water, the resulting mixture passing through openings 159 into the chamber 152. The impeller 157 mechanically agitates the oil and water, thereby further improving the mixture which is delivered through the openings 160 to the chamber 153. The impeller 118 creates further turbulence and mixing through mechanical agitation, and the resulting efficient fuel is delivered through the port 165 and the passage 166 to the pipe 167 leading to the oil burner for immediate combustion. With this arrangement, increased combustion efficiency for the fuel is provided.

To facilitate preparation and use of the fuel made in accordance with the invention, the mechanisms of a conventional oil burner can be effectively utilized. Referring to FIG. 9, oil and water mixture in a ratio discussed heretofore is supplied to inlet 200 of an oil burner pump 201. For example, the oil and water can be furnished from the tank 120 of FIG. 7.

The oil and water at a pressure on the order of 100 psi is then pumped through a line 202 to a reservoir 203 in which the oil and water separate but remain under pressure. A suitable bypass line leading back to the pump may be used if the pump is of a positive displacement type.

Oil line 204 and water line 205 lead respectively from the upper and lower portions of the reservoir 203 to to a fuel mixing apparatus 206 of the kind shown in FIGS. 1–2, 3–4, 4–5 or 8. The resulting efficient fuel is immediately fed to the oil burner nozzle 209 in the duct 207 for providing combustion in the furnace 208.

While the invention has been described in connection with several specific embodiments, it will be understood that various modifications will occur to those skilled in the art. Therefore the invention is not to be limited to the particular embodiments shown herein but is to be defined by the appended claims.

We claim:

1. Apparatus for preparing a fuel for an oil burner comprising an oil conduit adapted to receive fuel oil under pressure, a water conduit adapted to receive water under pressure and communicating with the oil conduit to flow the oil and water together in the oil conduit with 30 to 60% by volume of water, a first chamber formed with a first baffle, means for introducing the oil and water flow into the first chamber and for directing it against the first baffle for creating turbulence and for mixing of the oil and water, wherein said first baffle is disposed in the flow stream of said oil and water mixture for dispersing said mixture, outlet means in said first chamber on the downstream side of said baffle, a second chamber formed with a second baffle and communicating with the outlet of the first chamber to receive and direct the oil and water mixture against the second baffle to further mix the oil and water, wherein said second baffle is disposed in said second chamber in the flowstream of said oil and water mixture for dispersing said oil and water mixture, an air conduit communicating with the second chamber downstream of said baffle and adapted to receive air under pressure, the air conduit directing the compressed air into the further mixed oil and water for creating an efficient fuel, and an outlet conduit communicating with the second chamber downstream of said baffle for delivering the fuel to the oil burner.

2. Apparatus as defined in claim 1, wherein the water is heated.

3. Apparatus as defined in claim 1, wherein the water is heated to in excess of 175° F.

4. Apparatus as defined in claim 1, 2 or 3, wherein the oil is heated.

5. Apparatus as defined in claim 1, wherein the oil is heated to 140° to 175° F.

6. Apparatus as defined in claim 1, wherein the air conduit is arranged for introducing compressed air substantially at an angle perpendicular to the direction of the flow of the oil and water mixture.

7. Apparatus as defined in claim 1, comprising means for delivering compressed air to the first chamber for introducing air into the first chamber downstream of said baffle at sufficient pressure for creating turbulence and mixing said oil and water mixture.

8. Apparatus as defined in claim 7, wherein the air delivery means for the first and second chambers are arranged for introducing compressed air substantially perpendicular to the direction of flow of the oil and water mixture.

9. Apparatus for preparing a fuel for an oil burner comprising a pre-mixing chamber, an oil conduit adapted to receive fuel oil under pressure and opening into said pre-mixing chamber, a water conduit adapted to receive water under pressure and opening into said pre-mixing chamber, and compressed air delivery means opening into said pre-mixing chamber, a first mixing chamber, means for delivering a mixture of oil, water, and air from said pre-mixing chamber into said first mixing chamber, baffle means arranged in said first mixing chamber in the flowstream of said mixture for dispersing said mixture within said first mixing chamber, wherein said first mixing chamber includes an outlet disposed on the downstream side of said baffle, a second mixing chamber communicating with said first chamber outlet, second baffle means disposed in said second mixing chamber and arranged in the flow path of said mixture for dispersing said mixture in said second mixing chamber, and second outlet means in said second mixing chamber disposed downstream of said second baffle means for delivering the fuel to the oil burner.

10. Apparatus as defined in claim 9, comprising means for directing compressed air into said second mixing chamber downstream of said baffle at sufficient pressure for creating turbulence in said mixture.

11. Apparatus as defined in claim 9 or 10, comprising housing means including a plurality of third outlets, and means for mounting said second mixing chamber in said housing for moving selectively said second mixing chamber outlet into registry with one of said third outlets.

12. Apparatus as defined in claim 11, wherein said second mixing chamber is rotatably mounted in said second housing, and further comprising detent means on said housing for locking said second mixing chamber in a selected one of a plurality of rotatable positions.

13. Apparatus as defined in claim 1 or 9, wherein each said baffle is centrally disposed in said mixing chamber for dispersing said flow against the sides of said mixing chamber.

14. Apparatus as defined in claim 13, wherein each said mixing chamber is arranged for permitting expansion of said mixture when combined with air.

* * * * *